United States Patent [19]

Smith

[11] Patent Number: 4,742,662

[45] Date of Patent: May 10, 1988

[54] CEILING TRIM SUPPORT CLIPS

[76] Inventor: Owen J. Smith, 820 Park St., Saugatuck, Mich. 49453

[21] Appl. No.: 859,333

[22] Filed: May 5, 1986

[51] Int. Cl.[4] ..... E04B 5/57

[52] U.S. Cl. ..... 52/717.1; 52/489; 52/311; 52/DIG. 8

[58] Field of Search ..... 52/778, 489, 717.1, 52/484, 762, 311, 718, 312, DIG. 8

[56] References Cited

U.S. PATENT DOCUMENTS

| | | | |
|---|---|---|---|
| 345,001 | 7/1886 | Smith . | |
| 628,696 | 7/1899 | Chase . | |
| 1,224,315 | 5/1917 | Otte | 52/717.1 |
| 1,229,765 | 6/1917 | Lehman . | |
| 1,987,380 | 1/1935 | Triller | 52/718 |
| 2,322,650 | 6/1943 | Murphy | 52/717.1 |
| 2,471,254 | 5/1949 | Waara | 52/718 |
| 2,527,031 | 10/1950 | Rambusch . | |
| 3,013,644 | 12/1961 | Smith . | |
| 3,222,838 | 12/1965 | Sweeney | 52/717 |
| 3,290,852 | 12/1966 | Meyer | 52/717.1 |
| 3,319,389 | 5/1967 | Levine . | |
| 3,449,873 | 6/1969 | Damato . | |
| 3,565,478 | 2/1971 | George | 52/717.1 |
| 3,594,972 | 7/1971 | Jones et al. | 52/311 |
| 3,627,364 | 12/1971 | Van Riet . | |
| 3,677,589 | 7/1972 | Roles . | |
| 3,831,328 | 8/1974 | Mohr . | |
| 3,936,990 | 2/1976 | Garrison . | |
| 3,969,864 | 7/1976 | Stephenson . | |
| 3,991,537 | 11/1976 | Brown . | |
| 4,055,930 | 11/1977 | Weinar et al. | 52/717 |
| 4,063,391 | 12/1977 | Balinski et al. | 52/778 |
| 4,216,637 | 8/1980 | Kraus | 52/718 |
| 4,281,498 | 8/1981 | Kern . | |
| 4,367,616 | 1/1983 | Pearson . | |
| 4,452,021 | 6/1984 | Anderson . | |
| 4,454,700 | 6/1984 | Kern . | |

FOREIGN PATENT DOCUMENTS

| | | | |
|---|---|---|---|
| 27196 | 4/1981 | European Pat. Off. | 52/484 |
| 3218989 | 12/1982 | Fed. Rep. of Germany | 52/484 |
| 2517722 | 6/1983 | France | 52/484 |
| 2106157 | 4/1983 | United Kingdom | 52/484 |

*Primary Examiner*—John E. Murtagh
*Assistant Examiner*—Caroline D. Dennison
*Attorney, Agent, or Firm*—Price, Heneveld, Cooper, DeWitt & Litton

[57] ABSTRACT

A ceiling trim support clip that secures masking rails to ceiling support rails for a suspended ceiling. The clip includes spaced projections forming channels that snap over the edges of the ceiling support rail. One channel is deeper than the opposite channel, and a biasing element in the deeper channel biases the ceiling support rail toward the opposite projection to be seated in the channel therein. A wall mounting clip includes a hook spaced from a pair of upright projections, so that the hook is received over the outer edge of the wall rail and the projections slide between the wall rail and the supporting wall.

12 Claims, 2 Drawing Sheets

CEILING TRIM SUPPORT CLIPS

BACKGROUND OF THE INVENTION

The present invention relates to suspended ceiling systems, and in particular to ceiling systems having a grid work of T-shaped support rails that support removable ceiling panels.

Suspended ceiling systems are widely used to provide a dropped ceiling hung from the structural ceiling of a room. Such suspended ceilings provide an aesthetic method of masking heating and cooling ductwork, electrical conduits, light fixtures and other structures which are located above the suspended ceiling, while still providing ready access to these structures.

Typically, a conventional suspended ceiling system includes L-shaped or angled rails that extend along the walls of the room. These rails are nailed, screwed or otherwise fastened intermittently to the wall. Spaced across the center of the room are a number of inverted T-shaped main support rails that span between two opposite walls. These main support rails are suspended by wire hangers from the overhead structural ceiling of the room. These main support rails may also be supported in part by their opposite ends resting on the wall rails. A number of inverted T-shaped crosspieces are fitted between the main support rails in order to rest upon the upper surface of the main support rails' horizontal section. The interconnected main support rails, crosspieces and wall rails form a gridwork that overhangs the entirety of the room, and rectangular ceiling panels are laid on top of this gridwork to complete the ceiling system. Light fixtures, air vents and the like may be similarly supported on the suspended gridwork in a manner similar to the ceiling panels.

Although these suspended ceiling systems provide an adequate ceiling in most environments, due to the construction of the ceiling system the system often provides a commercial, prefabricated or inexpensive appearance. This commercial or austere appearance is in part produced by the use of thin aluminum or other metal rails to form the support gridwork. Since to a casual observer this metal gridwork is obviously that of suspended ceiling, it does not produce a permanent or residential appearance for the ceiling.

SUMMARY OF THE INVENTION

The present invention provides a ceiling support trim clip and system that masks the suspended ceiling support gridwork with decorative masking rails. The clip and system enable the decorative masking rails to be quickly snapped onto existing ceiling support gridwork. A mounting clip for a masking rail includes at least two projections that form flanges or channels that snap over the edges of conventional T-shaped ceiling support rail. The rail-receiving channels of the clip are spaced wider than the support rail, so that the clip can be fitted over one edge of the support rail and then pivoted into place. A biasing element biases the support rail from one projection toward the other projection in order to maintain the clip on the support rail.

In another preferred aspect of the invention, a masking rail is secured to a conventional ceiling supporting wall rail by a wall clip. The wall clip includes a hook that hooks over the outer edge of the wall support rail, and a pair of upstanding projections on the clip slide up between the wall support rail and the wall.

The clips and system are relatively inexpensive to manufacture and install, since the decorative masking rails may be quickly snapped over existing ceiling support rails without disassembling the ceiling supporting gridwork. The decorative masking rails may be made of a wood, wood simulating or other finished material so that when assembled the ceiling has an aesthetically pleasing finished or permanent appearance, thereby reducing the commercial appearance of the ceiling.

These and other objects, features and benefits of the invention will be recognized from the specification and claims which follow and the drawings appended hereto.

DETAILED DESCRIPTION OF THE PREFERRED EMBODIMENTS

Figure 1:
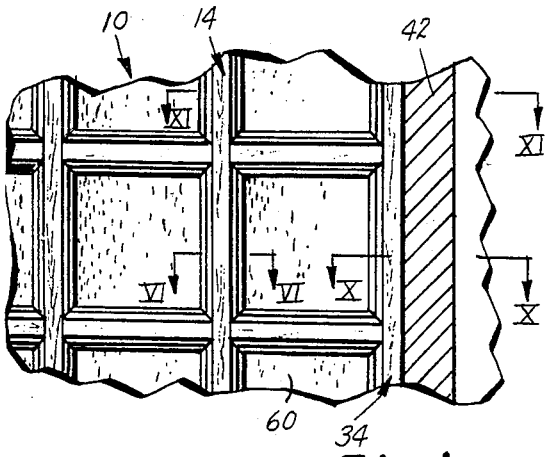
FIG. 1 is a fragmentary bottom plan view of a suspended ceiling system embodying the present invention.
Figure 6:
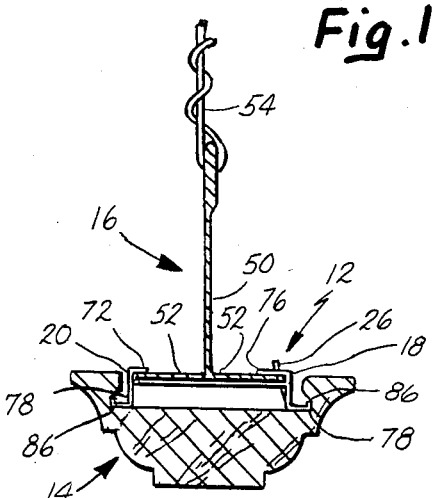
FIG. 6 is an end elevational sectional view of the assembly of FIG. 4, shown assembled onto the ceiling support rail.

The present invention is embodied in a system that provides masking rails on a gridwork for supporting a suspended ceiling, a preferred form of which is shown in FIG. 1 and referenced generally by the numeral 10. As shown in FIG. 6, a mounting clip 12 is used to mount a decorative masking rail 14 on the inverted T-shaped ceiling support rail 16 of a conventional suspended ceiling support system. Clip 12 includes spaced projections 18 and 20 (FIG. 2) that form a planar pair of channels 22 and 24, respectively, in which ceiling support rail 16 is received. Channel 22 is deeper than channel 24, and a spring element 26 is located in channel 22 to bias ceiling support rail 16 against opposite projection 20. During assembly ceiling support rail 16 is first slid into deeper channel 22 (FIG. 5) against spring 26, and clip 12 is then pivoted until rail 16 is received in shallower channel 24, with spring element 26 seating rail 16 in place.

Figure 11:
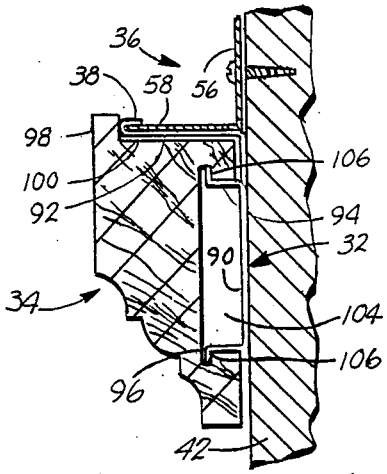
FIG. 11 is an end elevational view of the clip of FIG. 8, shown in assembled condition securing a masking wall rail to a ceiling supporting wall rail.

As shown in FIG. 11, a wall mounting clip 32 is used to mount a wall masking rail 34 to a wall ceiling support rail 36. Wall mounting clip 32 includes a hook 38 that hooks over the outer edge of wall ceiling support rail 36. A pair of generally upright projections 40 on wall mounting clip 32 slide up between wall ceiling support rail 36 and the supporting wall 42.

Figure 4:
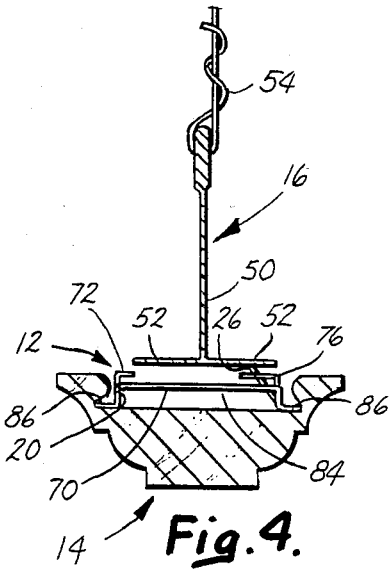
FIG. 4 is an end elevational, sectional view of a clip and masking rail assembly embodying the present invention, shown with a ceiling support rail in unassembled condition.

As shown in FIG. 4, the ceiling support system is conventional and includes a gridwork of inverted T-shaped support rails 16 that extend between opposite walls of the room and are spaced away from the remaining two walls. Each ceiling support rail 16 includes an upright middle beam 50 and two horizontal planar ceiling support beams 52 (FIG. 4). Support rails 16 are hung from the structural ceiling of the room by wire hangers 54 that pass through openings on upright beam 50. As shown in FIG. 11, wall ceiling support rails 36 extend along the four walls 42. Wall rails 36 are each generally L-shaped with a vertical beam 56 that is intermittently secured to wall 42 by screws 57, bolts, nails or other suitable fasteners. A generally planar horizontal beam 58 cantilevers out from the lower end of vertical beam 56 away from wall 42. The supporting gridwork is completed by a plurality of crosspieces (not shown) having a cross section similar to support rails 16 that are fitted inbetween adjacent and generally parallel ceiling support rails 16 and rest on planar ceiling support beams 52. The crosspieces may be additionally supported by wire hangers in a conventional manner. Similar crosspieces extend between wall ceiling support rails 36 and the next adjacent and generally parallel ceiling support rail 16 in a similar manner. The gridwork formed by ceiling support rails 16, wall ceiling support rails 36 and the interconnecting crosspieces support rectangular sections of ceiling panel 60 (FIG. 1) in a conventional fashion.

Figure 2:
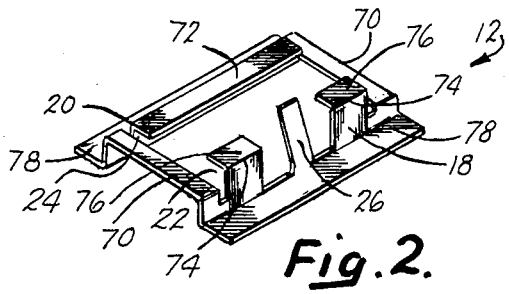
FIG. 2 is a perspective view of a trim mounting clip embodying the present invention.

As best shown in FIG. 2, clip 12 includes two interconnecting end brackets 70 that interconnect the two sides of clip 12 and form a part of the body thereof. Projection 20 provides a generally upright spacing flange that extends unbroken between interconnecting brackets 70. A hanging flange 72 extends inwardly from the upper end of projection 20 in a horizontal plane toward projection 18. Projection 18 is broken at spring element 26 into two spaced sections 74. An upper hanging flange 76 extends inwardly from the top of each of sections 74 in a horizontal plane toward projection 20. Opposed hanging flanges 72 and 76 therefore converge toward each other and lie in the same generally horizontal plane. A pair of securing flanges 78 extend outwardly from the sides at the base of mounting clip 12. Securing flanges 78 provide a means for securing mounting clip 12 to masking rail 14 as described below. Spring element 26 is a planar, rectangular tab that extends generally upwardly at an obtuse angle from one securing flange 78 between projection sections 74, and most preferably at an angle of about one hundred twenty degrees. Clip 12 is stamped from resilient metal, so that spring element 26 provides a resilient spring force biasing spring element 26 towards its at-rest position shown in FIG. 2.

Figure 3:
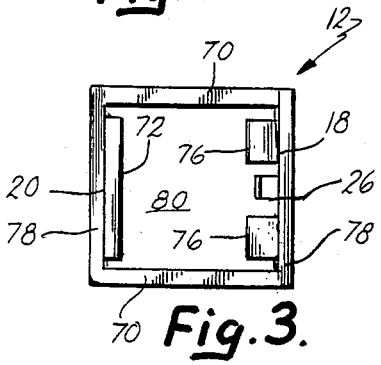
FIG. 3 is a top plan view of the clip of FIG. 2.

Hanging flanges 76 have a greater inward projection than that of hanging flange 72, so that channel 22 provides a deeper pocket or recess than that provided by channel 24. Most preferably hanging flanges 76 have an inward projection of about 0.265 inches, and hanging flange 72 has an inward projection of about 0.08 inches. As shown in FIG. 3, hanging flanges 76 and hanging flange 72 are spaced to provide a rail access passage 80 or opening that is narrower than the width of ceiling support beams 52 on ceiling support rail 16. Therefore, as shown in FIG. 6, interconnecting brackets 70 and projections 18 and 20 cooperate with hanging flanges 72 and 76 to form a rail receiving channel, with the outside edges of ceiling supporting beams 52 seated in channels 22 and 24 and interconnecting brackets 70 resting against the lower surface of ceiling supporting beams 52. Most preferably, projection 18 is spaced from projection 20 about 1.11 inches, so that rail access passage 80 is about 0.765 inches wide. Also most preferably, hanging flanges 72 and 76 are spaced about 0.08 inches above interconnecting brackets 70, and about 0.25 inches above securing flanges 78.

As shown in FIG. 4, masking rail 14 includes a clip seating recess 84 running along its top surface. Seating recess 84 is generally rectangular with widening grooves 86 extending along the closed lower end. Securing flanges 78 of clip 12 are received in widening grooves 86. Securing flanges 78 therefore prevent clip 12 from being pulled upwardly out of masking rail 34. Clip 12 is assembled into clip seating recess 84 by sliding clip 12 through the open end of masking rail 14 and along the length of seating recess 84 until it is appropriately positioned.

Figure 5:
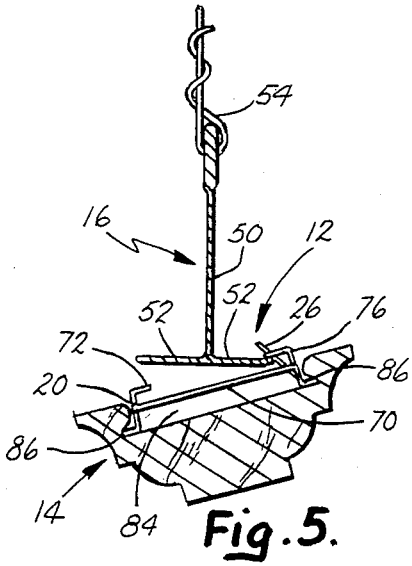
FIG. 5 is an end elevational, sectional view of the assembly of FIG. 4, shown being assembled onto the ceiling support rail.

In order to assemble masking rail 14 onto ceiling support rail 16, a number of clips 12 are seated along the length of clip seating recess 84. As shown in FIG. 5, clip 12 is first hooked over one edge of ceiling support rail 16 so that the ceiling support beam 52 slides under larger hanging flanges 76. Masking rail 14 is then pivoted about the edge of ceiling support rail 16 while the edge of support rail 16 is pressed against spring element 26. Spring element 26 is resiliently bent outward until the opposite edge of ceiling support rail 16 slips into channel 24 beneath narrower hanging flange 72. Spring element 26 then biases ceiling support rail 16 toward projection 20 in order to securely seat support rail 16, and preferably force ceiling support rail 16 against the side of projection 20.

Figure 7:
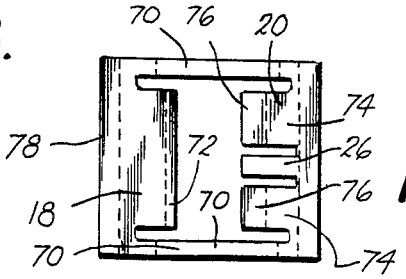
FIG. 7 is a top plan view of a clip blank used to form the clip of FIG. 2.

In manufacturing clip 12, a flat blank of rectangular metal (FIG. 7) is cut to provide projections 18 and 20 along with spring element 26 extending into the open area that eventually provides rail access passage 80. In blank form securing flanges 78 extend out of the same plane as interconnecting bracket 70. Clip 12 is then bent in a progressive stamping steps to bend the various flanges and projections into place.

Figure 8:
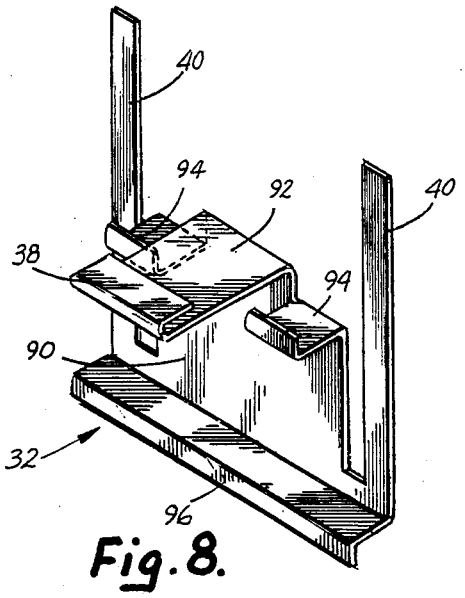
FIG. 8 is a perspective view of a wall rail mounting clip embodying the present invention.
Figure 10:
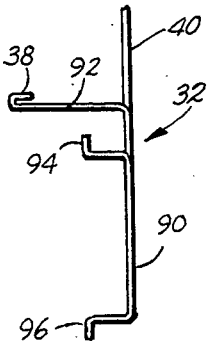
FIG. 10 is an end elevational view of the wall rail mounting clip of FIG. 8.

As shown in FIG. 8, wall mounting clip 32 includes a side base region 90 that exends along wall 42. Spaced upright projections 40 are generally planar and extend from either side of base 90. Hook 38 curves over from the edge of a horizontal bracket 92 that extends to one side of base region 90. Horizontal bracket 92 is approximately the same width as horizontal beam 58 on wall ceiling support 36, so that hook 38 will hook over the outer edge of horizontal beam 58 while upright projections 40 are positioned on the opposite side of vertical beam 56. Spaced below horizontal bracket 92 are a pair of upper securing flanges 94 that extend to one side of base 90 and each have upwardly bent ends. Securing flanges 94 are located on either side of horizontal bracket 92 and between upright projections 40. A single lower securing flange 96 extends to the same side of base 90 as upper securing flanges 94 and has a downwardly bent end. As shown in FIG. 10, the vertically bent ends of securing flanges 94 and 96 lie in the same vertical plane beneath horizontal bracket 92. Securing flanges 94 and 96 are used to secure wall mounting clip 32 to wall masking rail 34.

As shown in FIG. 11, wall masking rail 34 has a rectangular lip 98 that projects upwardly from a generally horizontal upper surface 100. Horizontal bracket 92 extends along upper surface 100 of rail 34, and lip 98 is spaced to project up in front of hook 38 and thus mask it from view when rail 34 is assembled onto wall ceiling support rail 36. Running along one side of wall masking rail 34 is a clip seating recess 104 that opens through the end of rail 34. A pair of widening grooves 106 extend in a vertical plane at the closed end of clip seating recess 104. Widening grooves 106 are spaced to receive securing flanges 94 and 96.

Wall mounting clip 32 is assembled onto wall masking rail 34 by sliding securing flanges 94 and 96 through the end of rail 34 into clip seating recess 104. After a plurality of wall mounting clips 32 are seated in seating recess 104, wall masking rail 34 is clipped over wall ceiling support rail 36. Hook 38 is hooked over the outer edge of horizontal beam 58, and the mounting clip 32 masking rail 34 assembly is pivoted about hook 38 until projections 40 slide up between wall ceiling support rail 36 and wall 42. Clip base 90 and the side of wall masking rail 34 then sit flush against wall 42 with lip 98 masking wall ceiling support rail 36 from the side.

Figure 12:
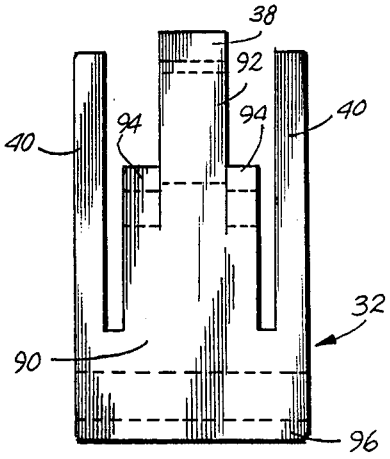
FIG. 12 is a front elevational view of a clip blank used to form the wall rail mounting clip of FIG. 8.
Figure 9:
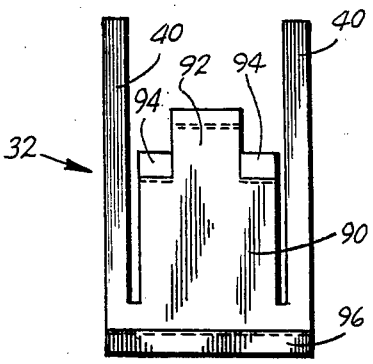
FIG. 9 is a front elevational view of the wall rail mounting clip of FIG. 8.

As shown in FIG. 12, wall mounting clip 32 is formed from a flat clip blank that is cut to provide tabs that lie in a common plant and which eventually become projections 40, hook 38, horizontal bracket 92, upper securing flanges 94 and lower securing flange 96. All of the various projections and flanges are thereafter formed in progressive stamping steps.

Figure 13:
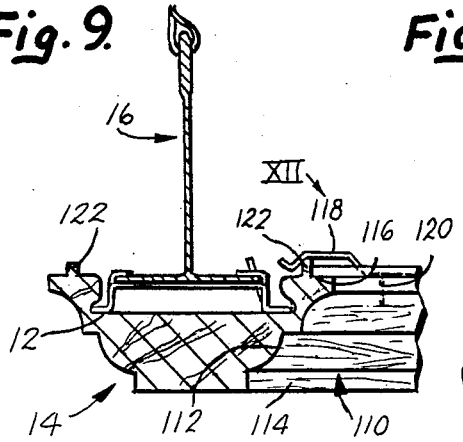
FIG. 13 is a fragmentary, end elevational sectional view of the assembled ceiling system of FIG. 1.
Figure 13:
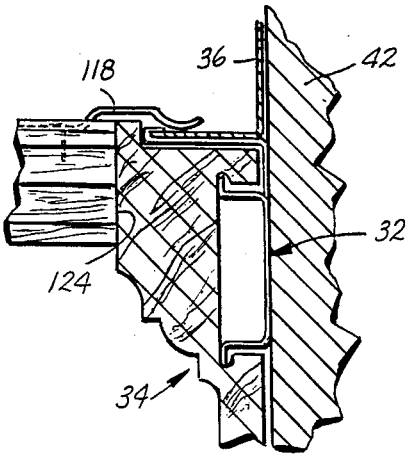

As shown in FIG. 13, a masking rail 14 has been assembled onto a ceiling support rail 16, and a wall masking rail 34 has been assembled onto a wall ceiling support rail 36. The metal crosspieces are removed and crosspieces 110 are then supported directly by masking rails 14 and wall masking rails 34. Alternatively, crosspieces 110 may be secured over the metal crosspieces (not shown) extending between adjacent ceiling support rails 16 or between a ceiling support rail 16 and wall ceiling support rail 36, using mounting clips 12 in the same manner as described above.

Preferably masking rail 14, wall masking rail 34 and crosspieces 110 are made from a decorative wood and have a configured lower surface. Alternatively, these elements may be made from a wood simulating material, or other suitable materials to provide a finished appearance to the ceiling support gridwork.

It is to be understood that the above is merely a description of the preferred embodiment and that various modifications or improvements may be made without departing from the spirit of the invention disclosed herein. The scope of protection to be afforded is to be determined by the claims which follow and the breadth of interpretation which the law allows.

The embodiments of the invention in which an exclusive property or privilege is claimed are defined as follows:

1. A system for masking a grid of ceiling support members each having a generally planar ceiling panel support surface of a preselected width, comprising:

an elongated masking rail having an upper masking surface and a lower surface;

a clip adapted for coupling said masking rail to one of said ceiling support members, said clip having a body with means for securing said clip body to said upper masking surface, a first hanging flange spaced above said body by a first spacing flange and a second hanging flange spaced above said body by a second spacing flange, said first hanging flange and said second hanging flange extending toward each other and laterally spaced to define an access passage therebetween that is narrower than said ceiling support member width, said first spacing flange laterally spaced from said second spacing flange greater than said ceiling support member width and said first spacing flange spaced from said second hanging flange narrower than said ceiling support member width; and means on said clip for laterally biasing a ceiling support member received under said hanging flanges toward said first spacing flange, whereby an edge of the ceiling support member is received under said second hanging flange and said clip is then pivoted until said biasing means laterally biases the ceiling support member under said first hanging flange.

2. The system of claim 1, wherein:

said second hanging flange is wider than said first hanging flange.

3. The system of claim 2, wherein:

said biasing means includes a spring flange projecting upwardly from said clip body.

4. The system of claim 3, wherein:

said second spacing flange includes two spacing flange sections, said spring flange located between said spacing flange sections.

5. The system of claim 4, wherein:

said securing means includes a pair of securing flanges extending outwardly from said clip body; and said masking rail includes a channel extending along the upper surface of said masking rail, said channel configured to receive said securing flanges.

6. The system of claim 1, wherein:

said securing means includes a pair of securing flanges extending outwardly from said clip body; and said masking rail includes a channel extending along the upper surface of said masking rail, said channel configured to receive said securing flanges.

7. The system of claim 1, further comprising:

a wall masking rail adapted for extending along a wall and masking a ceiling support rail extending along said wall; and a wall clip adapted for coupling said wall masking rail to a ceiling support rail extending along a wall and having an abutting edge abutting the wall and an outer edge spaced away from the wall, said wall clip including means for securing said wall clip to said wall masking rail, said wall clip having a hook adapted to be secured over the ceiling support rail outer edge, and said wall clip including a projection spaced from said hook and adapted to extend upwardly between the ceiling support rail abutting edge and the wall.

8. The system of claim 7, wherein:

said wall clip includes two of said upright projections, said hook located between said upright projections.

9. The system of claim 8, wherein:

said securing means includes a clip body depending from said projections, and two securing flanges extending from one side of said clip body, said securing flanges having free ends extending generally away from each other; and said wall masking rail including a channel extending along one side thereof, said channel adapted to receive said securing flanges of said wall clip.

10. The system of claim 9, wherein:

said securing flanges are an upper securing flange and a lower securing flange, said upper securing flange having two spaced securing flange sections, said hook located between said securing flange sections.

11. The system of claim 1, further comprising:

a plurality of said masking rails extending generally parallel to each other;

a plurality of crosspieces extending between said masking rails, each said crosspiece having an end mating with a side of one of said masking rails, said crosspiece ends having a lower surface extending past an upper surface of said crosspiece;

a hook projecting laterally from said upper surface of each of said crosspieces; and said masking rails each having a hook seat thereon, whereby said crosspiece hooks are secured in said hook seats with said crosspiece lower surface extending beneath a portion of said masking rail.

12. The system of claim 11, wherein:

said hooks are resilient.

* * * * *